US008112913B2

(12) United States Patent
Sirr

(10) Patent No.: US 8,112,913 B2
(45) Date of Patent: Feb. 14, 2012

(54) MULTI-PURPOSE BUCKET

(76) Inventor: Chester Lea Sirr, Kelowna (CA)

( * ) Notice: Subject to any disclaimer, the term of this patent is extended or adjusted under 35 U.S.C. 154(b) by 0 days.

(21) Appl. No.: 12/588,859

(22) Filed: Oct. 30, 2009

(65) Prior Publication Data

US 2011/0099860 A1 May 5, 2011

(51) Int. Cl.
*E02F 3/40* (2006.01)

(52) U.S. Cl. ..... 37/444; 37/379; 37/403; 37/443; 414/722

(58) Field of Classification Search ..... 37/444, 37/314–316, 341, 379, 403–410, 443, 461, 37/184; 414/722–724, 726, 729, 732
See application file for complete search history.

(56) References Cited

U.S. PATENT DOCUMENTS

| | | | | | |
|---|---|---|---|---|---|
| 3,003,265 | A * | 10/1961 | Lutjens | 37/444 |
| 3,072,257 | A * | 1/1963 | Hockenberry | 171/132 |
| 3,299,548 | A * | 1/1967 | Freyer | 37/184 |
| 3,375,595 | A * | 4/1968 | Beltrami | 37/406 |
| 3,461,968 | A * | 8/1969 | Longley | 171/132 |
| 3,581,924 | A * | 6/1971 | Marz | 414/704 |
| 3,765,490 | A * | 10/1973 | Logue | 171/132 |
| 3,767,070 | A * | 10/1973 | Arnold | 37/406 |
| 3,854,608 | A * | 12/1974 | Arnold | 414/697 |
| 4,805,703 | A * | 2/1989 | Carlsson | 171/132 |
| 5,160,034 | A * | 11/1992 | Potter | 209/38 |
| 5,241,764 | A * | 9/1993 | Modig | 37/405 |
| 5,311,684 | A * | 5/1994 | Van Dalfsen | 37/409 |
| 5,398,430 | A * | 3/1995 | Scott et al. | 37/142.5 |
| 5,405,092 | A * | 4/1995 | Jonninen | 241/27 |
| 5,596,824 | A * | 1/1997 | Scott et al. | 37/403 |
| 5,649,377 | A * | 7/1997 | Tanada | 37/406 |
| 5,743,030 | A * | 4/1998 | Sirr | 37/406 |
| 5,964,050 | A * | 10/1999 | Svahn | 37/409 |
| 6,108,945 | A * | 8/2000 | Cronk, Jr. | 37/142.5 |
| 6,135,290 | A * | 10/2000 | Heiple | 209/421 |
| 6,237,257 | B1 * | 5/2001 | Cronk, Jr. | 37/142.5 |
| 6,341,933 | B1 * | 1/2002 | Gagnon et al. | 414/725 |
| 6,370,801 | B1 * | 4/2002 | Weyer et al. | 37/406 |
| 6,375,012 | B1 * | 4/2002 | Leyland et al. | 209/421 |
| 6,490,815 | B1 * | 12/2002 | Pratt | 37/408 |
| 6,612,051 | B2 * | 9/2003 | Weyer et al. | 37/406 |
| 6,722,505 | B2 * | 4/2004 | Kobayashi | 209/421 |
| 6,789,337 | B2 * | 9/2004 | Mallaghan | 37/403 |
| 6,834,447 | B1 * | 12/2004 | Currey | 37/142.5 |
| 7,007,877 | B1 * | 3/2006 | Kuhmonen | 241/236 |
| 7,117,951 | B2 * | 10/2006 | Stevens | 171/105 |
| 7,204,046 | B2 * | 4/2007 | Currey | 37/142.5 |
| 7,380,674 | B2 * | 6/2008 | Vaine | 209/420 |
| 7,445,122 | B2 * | 11/2008 | Currey | 209/674 |
| 7,591,379 | B2 * | 9/2009 | Turnbull | 209/419 |
| 2009/0211121 | A1 * | 8/2009 | Doster et al. | 37/468 |

* cited by examiner

*Primary Examiner* — Thomas Beach
*Assistant Examiner* — Matthew Buck
(74) *Attorney, Agent, or Firm* — Richard D. Okimaw

(57) ABSTRACT

Disclosed is a multi-configurable bucket for screening material comprising a blade having a bottom edge, a top edge and a connector therebetween for securing to a distal end of the arm of a earth moving equipment. The bucket has a bottom screen having front and rear edges being rotatable about the top edge of the blade section. The bottom screen is positionable so as to extend angled away from the bottom edge of the blade. The bucket further comprises a front screen rotatable relative to the bottom screen having a main screen portion and an angled end screen portion. The front screen is positionable to a closed position proximate the front edge of the bottom screen such that the front edge of the bottom screen extends past the angled bottom portion of the front screen.

13 Claims, 7 Drawing Sheets

MULTI-PURPOSE BUCKET

BACKGROUND OF THE INVENTION

1. Field of Invention

The present invention relates to screening material, and in particular to a particle size separating bucket for earth moving equipment.

2. Description of Related Art

The requirement for screening aggregate or the like on the site of a construction operation normally requires the use of a separate screen of one form or another. To achieve the required result, a front end loader, backhoe or other earth moving type equipment is used to load the screen and eventually pick-up the screened (separated) material and/or the rejects and move them to their place of utility.

At many remote locations, it is often necessary to both excavate material and to provide screened material for the same site. In such locations, it is frequently necessary to excavate the material and remove it from the site with a dump truck or the like. It is also necessary to transport screened material back to the same site for use in construction of roads and the like. Such duplication of equipment and transportation is unnecessary and cost prohibitive for many job sites. Previous attempts to provide equipment that functions, not just as an earth mover but also as a particle screening or separating device have not been suitable.

Such previous attempts to provide a screening devices have not enabled the screening apparatus to also function as an excavating bucket. Although previous screens have been utilized on loading buckets, such buckets do not enable the operator to dig substantially below grade as does an excavator bucket. Such devices also require an external power or agitating source such as a vibrator to ensure the material will be passed through the screen. Such vibrators add wear and tear to the device as well as add additional complexity.

U.S. Pat. No. 3,072,257 issued Jan. 8, 1963 to Hawkenberry describes a combined gravel collecting and straining system formed in the bucket of an earth mover having a blade, a collecting section and a screen section. The screen section forms part of the floor of the bucket adjacent to the free end of the collecting section, i.e. projecting from the collecting section in the direction away from the blade. In this system, the blade and collecting section combine to pick up the gravel or the like to be screened and then the bucket is oriented to move the material away from the blade section against a dam at the free or leading end of the screening section and onto the screening section. Shaking or otherwise moving the bucket sifts the finer material through the screen. A suitable barricade or dam must be provided at the free end of the extended bucket to prevent the material from simply sliding off the free end of the screen without being screened. There is no appreciable way to dig substantially below grade as the bucket will only load material and not excavate.

Two recent U.S. Pat. Nos. 5,311,684 issued May 17, 1994 to Dalfsen and 5,405,092 issued Apr. 11, 1995 to Jonninen, describe systems for scooping and crushing using live elements that are rotated within the scooping element to crush or reduce the particle size before the particles are released. These devices are quite complicated and generally require a dedicated bucket system that is only suitable for use for this purpose. These devices also do not provide a way to excavate material below grade and are.

SUMMARY OF THE INVENTION

According to a first embodiment of the present invention there is disclosed a multi-configurable bucket for screening material comprising a blade having a bottom edge, a top edge and a connector therebetween for securing to a distal end of the arm of a earth moving equipment. The bucket further comprises a bottom screen having front and rear edges being rotatable about the top edge of the blade section. The bottom screen is positionable so as to extend angled away from the bottom edge of the blade. The bucket further comprises a front screen rotatable relative to the bottom screen having a main screen portion and an angled end-screen portion. The front screen is positionable to a closed position proximate the front edge of the bottom screen such that the front edge of the bottom screen extends past the angled bottom portion of the front screen.

The bottom screen may be pivotally connected to the blade proximate to the top edge thereof. The front screen may be pivotally connected to the blade proximate to the top edge thereof. The front screen and bottom screen may be pivotally connected to the blade proximate to the top edge thereof at a common pivot.

At the closed position the end screen portion of the front screen may angle towards the blade. At the closed position, the front edge of the bottom screen may extend past the end screen portion of the front screen by at least 6 inches. The main screen portion and end screen portion of the front screen and the bottom screen may form a segmented screening surface.

The main screen portion and end screen portion of the front screen and the bottom screen may be angularly oriented relative to each other by angles of greater than 100 degrees. The front screen may be openable so as to permit the blade and bottom screen to excavate soil material. The bottom screen may comprise a substantially planar screening surface supported by opposed side plates.

The bottom screen and front screen may be formed of plastic. The bottom screen and front screen may be supported by a plurality of parallel spaced apart tines. The front edge of the bottom screen may extend past the tines of the end screen portion of the front screen by at least 6 inches.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
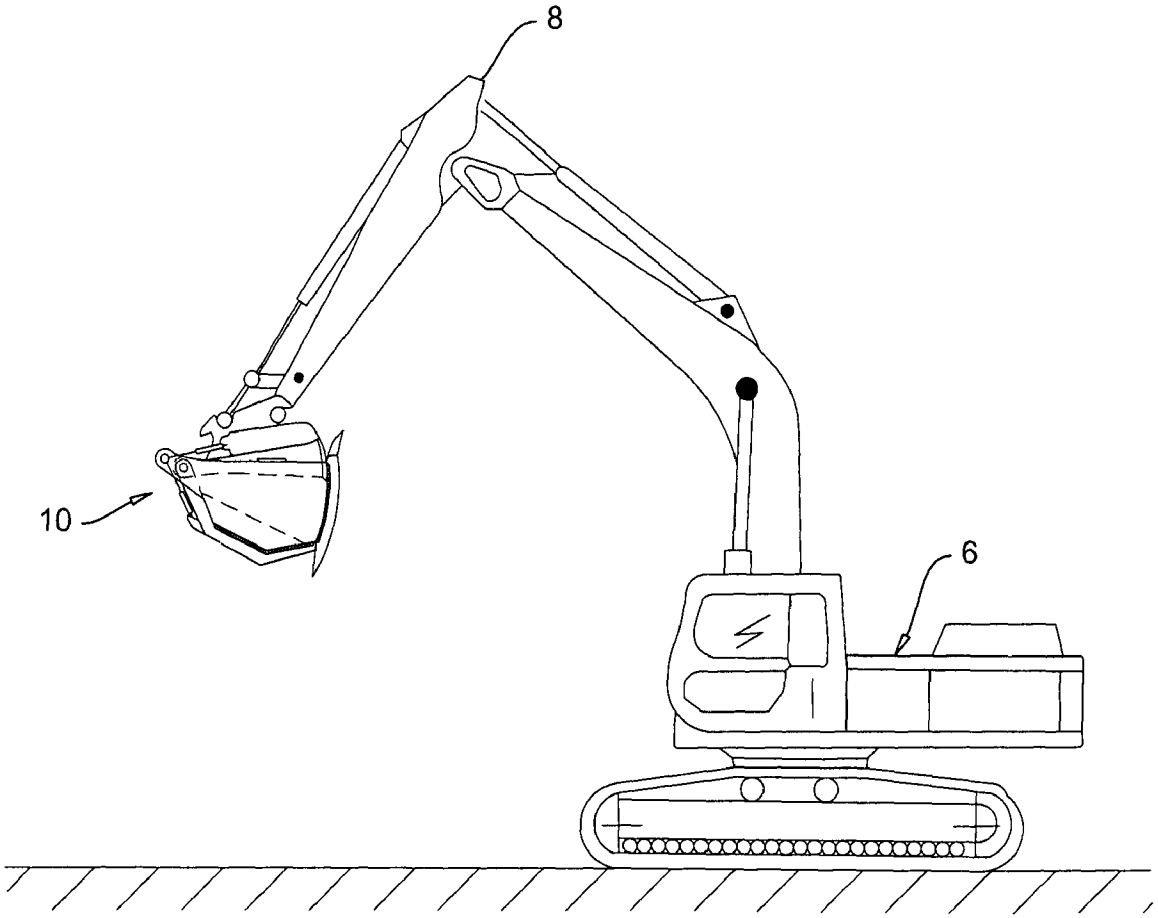
FIG. 1 is a side view of an excavator having a bucket according to a first embodiment of the present invention on the end of it's arm.
Figure 2:
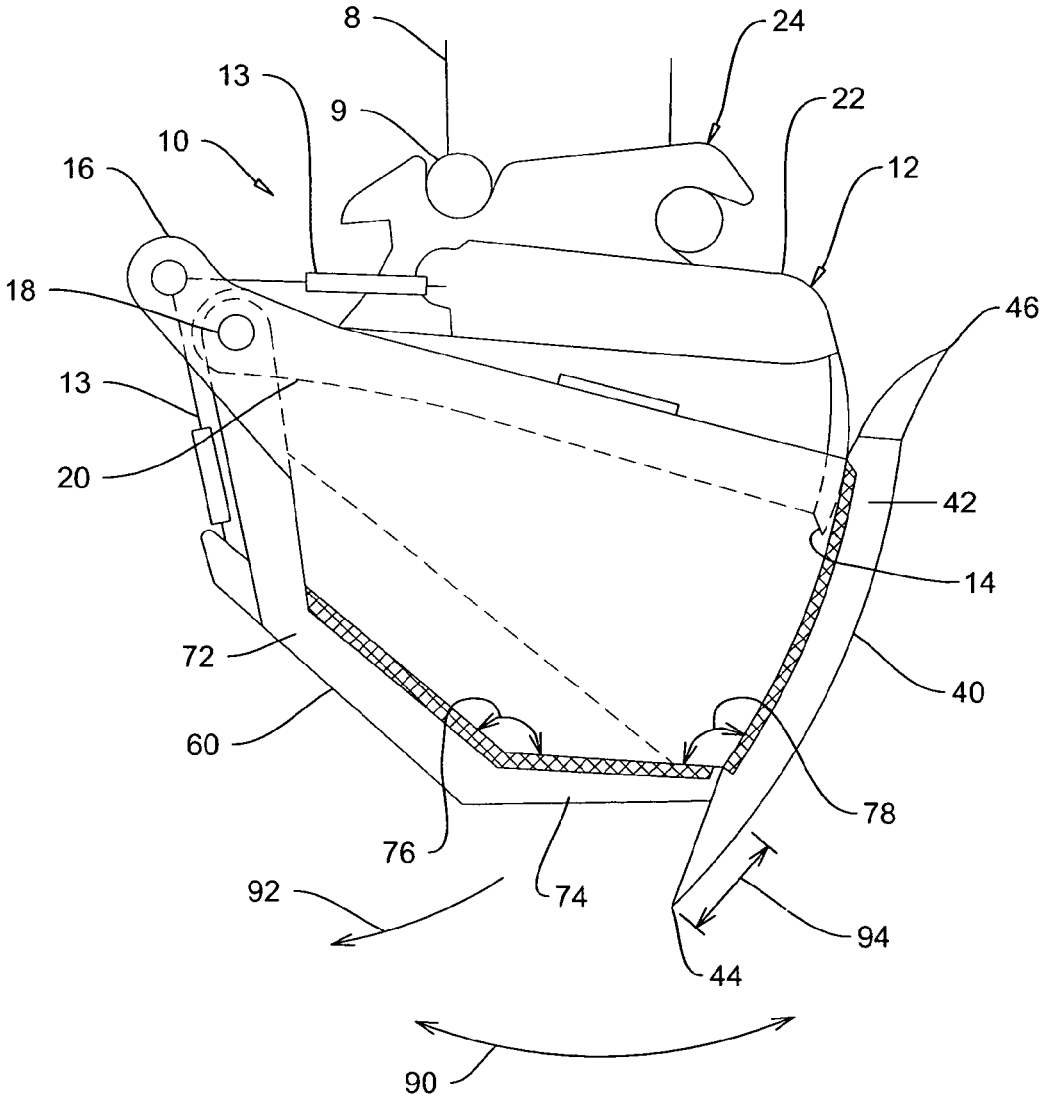
FIG. 2 is a cross-sectional view of the bucket of FIG. 1 taken along the line 2-2 in a closed position.
Figure 3:
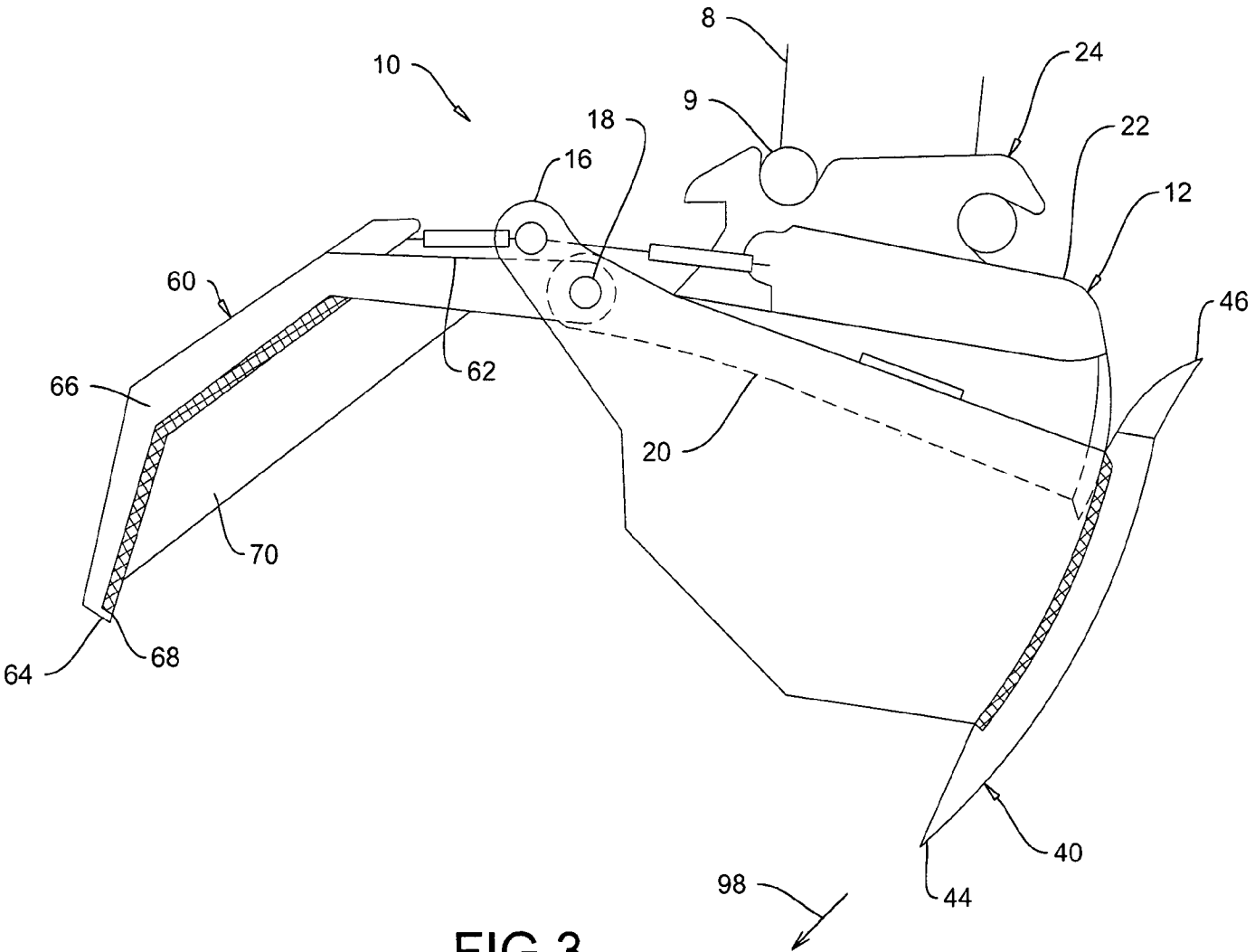
FIG. 3 is a cross-sectional view of the bucket of FIG. 1 taken along the line 2-2 in an open excavating position.
Figure 4:
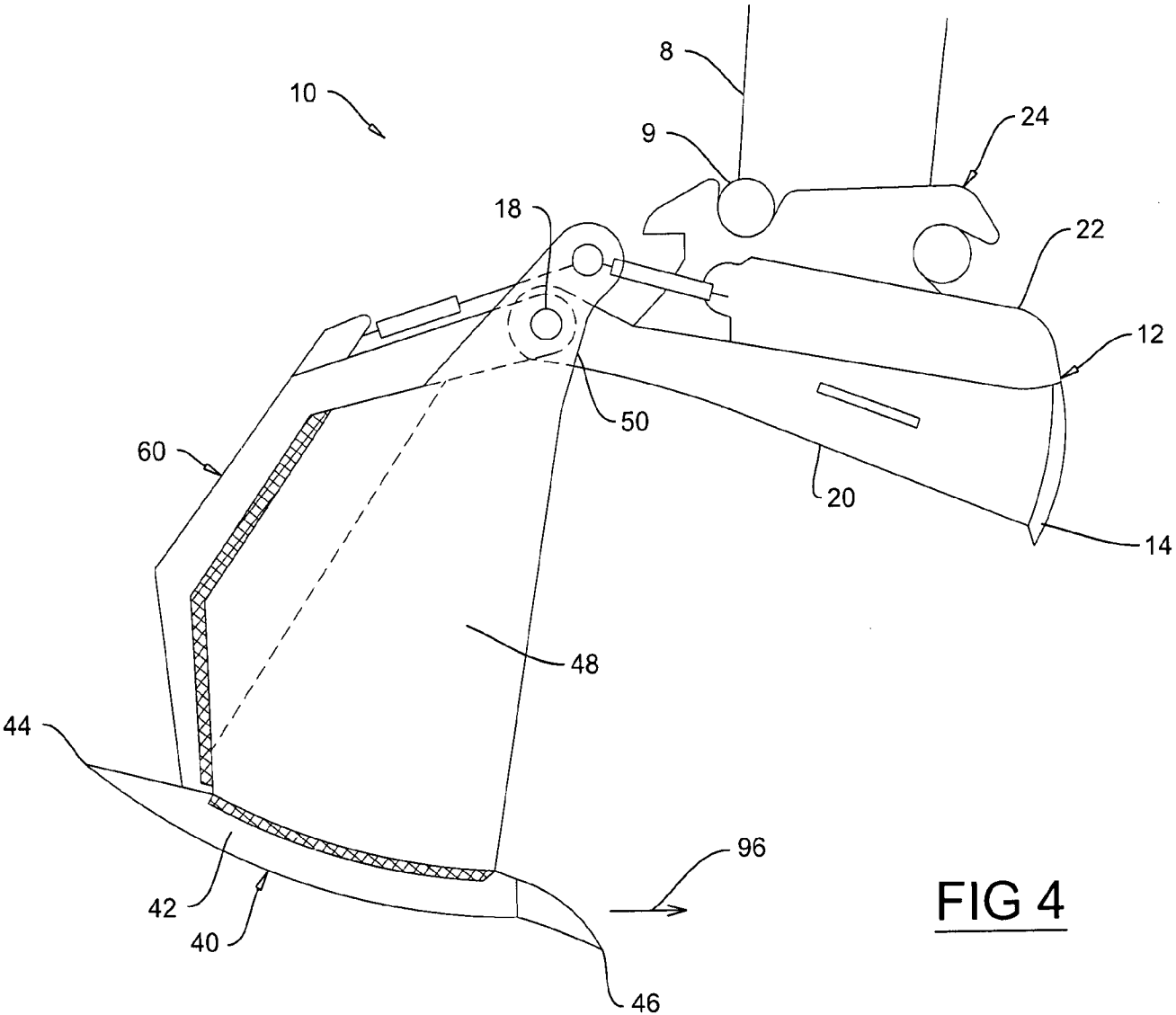
FIG. 4 is a cross-sectional view of the bucket of FIG. 1 taken along the line 2-2 in an open loading position.

Referring to FIGS. 1 through 5, a bucket according to a first embodiment of the invention is shown generally at 10 supported on the end of the articulated arm or boom 8 of an earth moving vehicle 6 or the like. Although the bucket 10 is shown on the end of an excavator arm, it will be appreciated that the bucket may be utilized with other types of earth moving vehicles as well, such as by way of non-limiting example, a loader or a front end loader. The present bucket 10 will enable the operator of the earth moving vehicle 6 to excavate, load, or screen soil material. With reference to FIGS. 2 through 4, the bucket 10 comprises a blade 12, a bottom screen 40 and a front screen 60 pivotally secured to each other to as to be arrangable in a plurality of orientations to suite differing functions. The front screen 60 and bottom screen 40 may be rotated relative to the blade by any conventional arrangement of hydraulic cylinders 13 as are commonly known.

The bucket 10 may be mounted on any suitable moving device, such as the arm 8 and in any conventional manner and movable relative to the earth moving vehicle 6 via a hydraulic cylinder(s) or the like. Generally, blade 12 of the bucket 10 is pivotably mounted at the free end of the arm 8 via a pivot connection 9 as are conventionally known. The orientation of the bucket 10 relative to the arm 8 or earth moving vehicle 6 is regulated by a suitable hydraulic cylinder or the like.

The blade 12 comprises an elongate body having bottom and top edges, 14 and 16, respectively and front and rear surfaces, 20 and 22, respectively. The rear surface 22 includes a connector 24 of a known type for connecting the bucket 10 to the distal end of the arm 8 of a piece of earth moving vehicle 6. Although a quick coupler type connection is illustrated in the accompanying figures, it will be appreciated that other types of connectors may be utilized as well. The top edge 16 of the blade 12 includes a pivot 18 for pivotally mounting the bottom and front screens 40 and 60. As illustrated the bottom and front screens 40 and 60 may be pivotally secured to the blade 12 at a common pivot 18. Alternatively, the bottom and front screens 40 and 60 may be pivotally mounted to the blade about separate pivot mounts. In still further embodiments, the front screen 60 may be pivotally mounted to the bottom screen 40 while the bottom screen is pivotally mounted to the blade 12. The pivot 18 may comprise a pivot pin or any other known rotatable connector.

The bottom screen 40 comprises a substantially planar or segmented screening section 42 having front and rear edges 44 and 46, respectively. The front and rear edges 44 and 46 may include smooth or toothed digging edges as are commonly known in the art. The bottom screen 40 includes a pair of axial side walls 48, only one of which is shown in the accompanying figures, one at each side of the bottom screening section 42. Each side wall 48 includes a top distal end 50 which is pivotally connected to the pivot 18 as described above. The side walls 48 are positioned outside of the blade 12.

Figure 6:
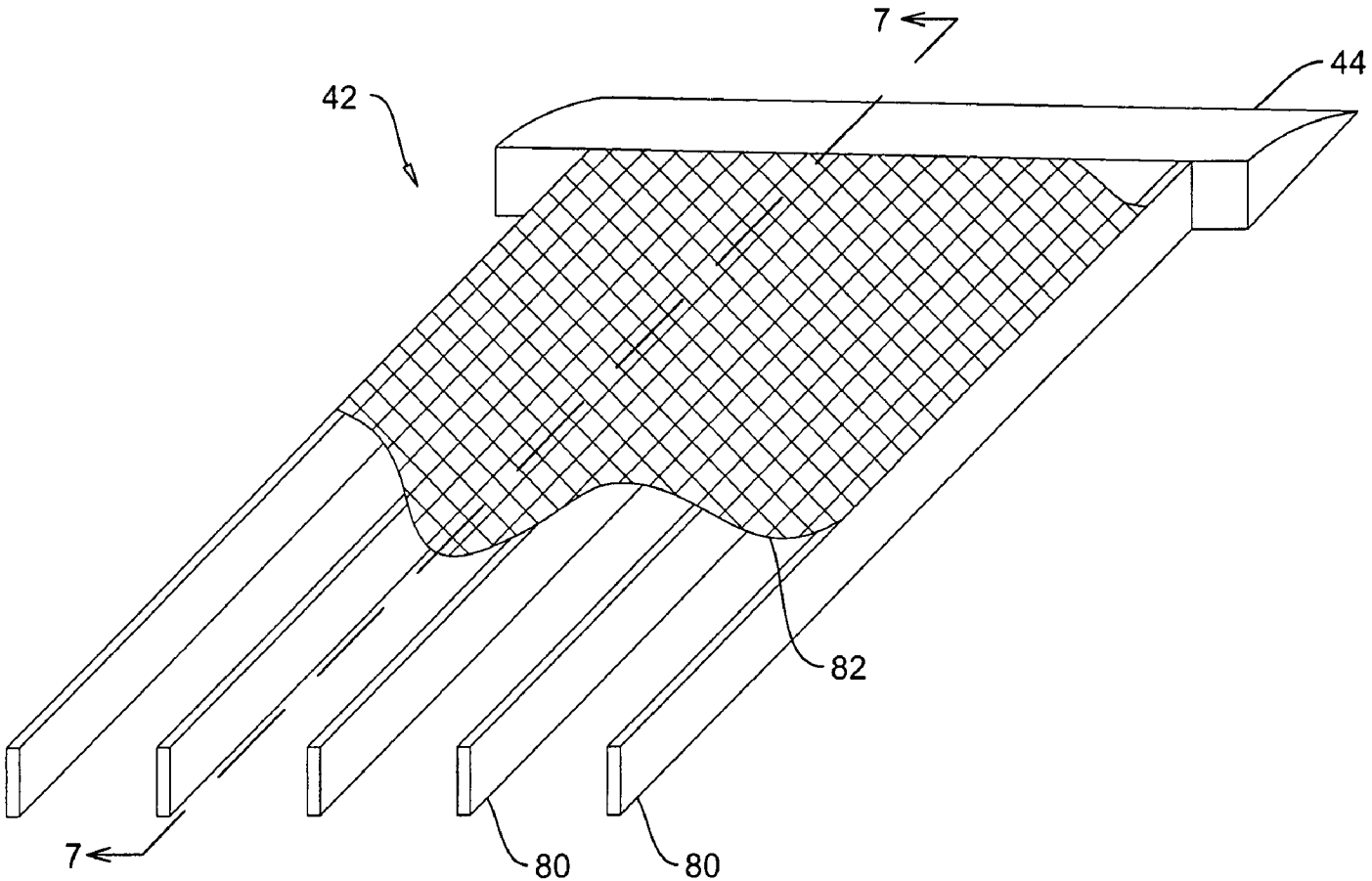
FIG. 6 is a cross-sectional view of the bottom screen of the bucket of FIG. 1.

As illustrated in FIG. 6, the bottom screening section 42 is comprised of a plurality of spaced apart tines or forks 80 extending between the front and rear edges 44 and 46 of the bottom screen 40 having a sheet of screening material 82 secured thereto. The screening material may be a plate of screening material and may be secured to the tines 80 with a suitable clamping mechanism such as by way of non-limiting example, fasteners, overlapping flanges or adhesives. In particular, the screening material 82 may be secured in position by fasteners or the like which have been passed through the plate screening material 82 and screwed into the tines 80. The heads of these fasteners will preferably be substantially flush with the surface of the screening material 82. The screening material 82 may comprise a grate or other similar screening structure and may be formed of any suitable material. In particular, it has been found that forming the screening material 82 of plastic such as polyvinyl chloride (PVC), polyethylene, (PE), polycarbonate, cellulose acetate, acrylonitrile butadiene styrene (ABS), acrylic or ultra high molecular weight polyethylene (UHMW) by way of non-limiting example. It will be appreciated that other materials may also be useful as well.

The front screen 60 comprises an arcuate member having a proximate end 62 pivotally connected to the blade 12 and a free distal edge 64. The front screen comprises a plurality of tines 66 supporting a screening panel 68 as shown and described with reference to FIG. 6 above. The front screen 60 includes a pair of axial side walls 70, only one of which is shown in the accompanying figures which may be received between the side walls 48 of the bottom screen. As illustrated, the front screen 60 comprises a plurality of segments angularly connected to each other to form the arcuate shape illustrated. The front screen 60 includes a main portion 72 and an end portion 74, the purpose of which will be more fully described below. The main portion 72 and end portion are angularly connected to each other so as to form a first angle generally indicated at 76 therebetween As illustrated in FIG. 2, the bucket 10 may be configured such that the blade 12, bottom screen 40 and front screen 60 are continuous with each other in a closed or screening configuration. In such a configuration, the bucket 10 may be utilized to screen or sift soil or other material therein. As illustrated, in the screening configuration, the end portion 74 of the front screen 60 and the bottom screen 40 form a second angle generally indicated at 78 therebetween. In the screening configuration, the bucket 10 may be rocked or otherwise cyclically moved back and forth in a rotational motion as indicated generally at 90. In such a motion, the soil contained within the bucket 10 will be moved back and forth across the bottom and front screen 40 and 60 so as to assist in the bucket in screening the material. The first and second angles should be chose so as to not unduly impede movement of the soil over the screens. In particular, the applicant has found that angles of greater than 100 degrees has been useful for the first and second angles 76 and 78 although it will be appreciated that wider angles will be more useful for allowing movement of material within the bucket.

Additionally, in the configuration shown in FIG. 2, the bucket 10 may also be utilized for moving soil or forwarding. The exterior of the front screen 60 and the front edge 44 of the bottom screen 40 of the bucket 10 may be engaged against a soil formation and thereafter utilized to push the soil forward in a motion generally indicated at 92. As illustrated, the bottom portion 74 of the front screen 60 is set back from the front edge 44 of the bottom screen by a setback distance generally indicated at 94. It will be appreciated that locating the end portion 74 back of the front edge 44 will prevent the tines and screen material of the front screen 60 from being damaged by such a motion as the front edge 44 which is better suited to digging will primarily engage the soil. This will also prevent the tines from becoming jammed and clogged by soil and rock from such a motion. In practice, it has been found that a set back distance of 6 inches has been suitable, although it will be appreciated that other distances may be useful as well.

Turning now to FIG. 3, the bucket 10 may be utilized for loading by opening the front screen 60 away from the bottom screen 40 and may thereafter be used to scoop material at or above grade as is typically performed by a loader with a loading motion generally indicated at 98. It will be appreciated, that such a movement may be utilized for conventional loading as well as to fill the bucket 10 with material that is to be screened as illustrated in FIG. 2. In such a sequence, after the bucket 10 has been filled, the front screen 60 may be moved to the position showing in FIG. 2 and thereafter utilized to screen the material as described above.

With reference to FIG. 4, the bucket 10 may also be utilized in an excavating configuration as shown. In the excavating configuration, the front and bottom screen 60 and 40 are rotated away from the blade 12 and moving the bucket in a downward motion towards the earth moving vehicle 6 as generally indicated at 96. It will be appreciated, that such a movement may be utilized for conventional loading as well as to fill the bucket 10 with material that is to be screened as illustrated in FIG. 2. In such a sequence, after the bucket 10 has been filled, the front screen 60 may be moved to the position showing in FIG. 2 and thereafter utilized to screen the material as described above.

It will be seen that through the use of the bucket 10 of the present description, work can be generated (ie. the bucket filled) in the normal excavating direction as well as in the opposite direction, creating a significant improvement in productivity for an excavator. Conventional excavators only generate work in one direction, by digging toward the excavator. In such an operation, the reaching out movement is only a set up to being able to dig. With the present bucket 10, material can also be forwarded with closed bucket as described above or loaded by pushing away with the cutting edge of the bottom screen. Utilizing a conventional bucket, the digging or working area is typically at grade (track level) or below. To work a pile above grade the excavator climbs the pile so it can dig below track level. With the use of the above bucket, the excavator may work above grade by front loading or below grade by digging.

Figure 5:
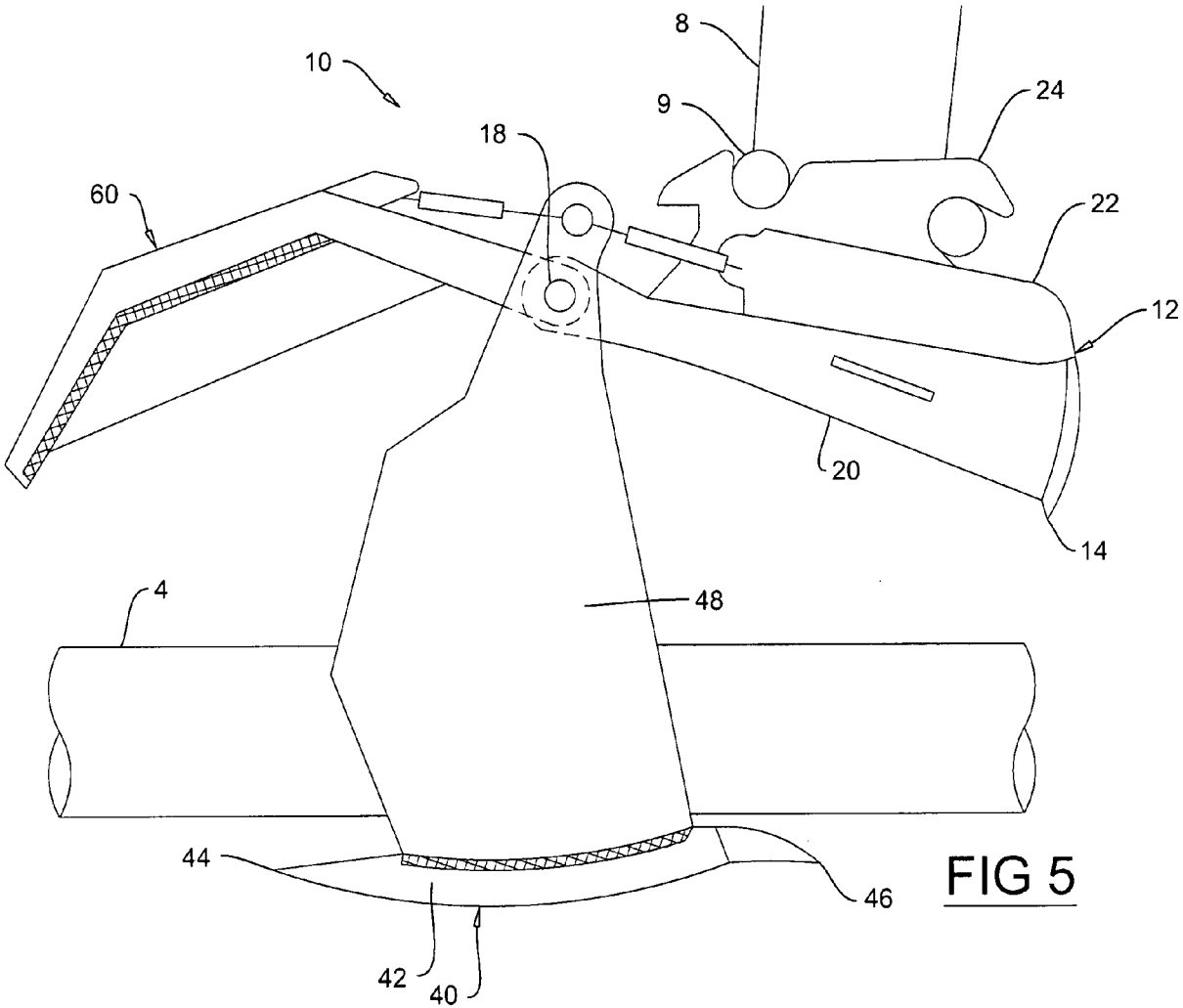
FIG. 5 is a perspective view of the screen and supporting tines of the bucket of FIG. 1.

As illustrated in FIG. 5, the bucket 10 may also have the bottom screen 40 rotated away from the blade 12 and the front screen 60 rotated away from the bottom screen 40. In such a configuration, the bottom screen 40 of the bucket 10 is able to support an elongate object, such as a log 4 or the like longitudinally along the bottom screen such that the blade 12 and the front screen 60 may be engaged upon the top of the log to retain it within the bucket.

Figure 7:
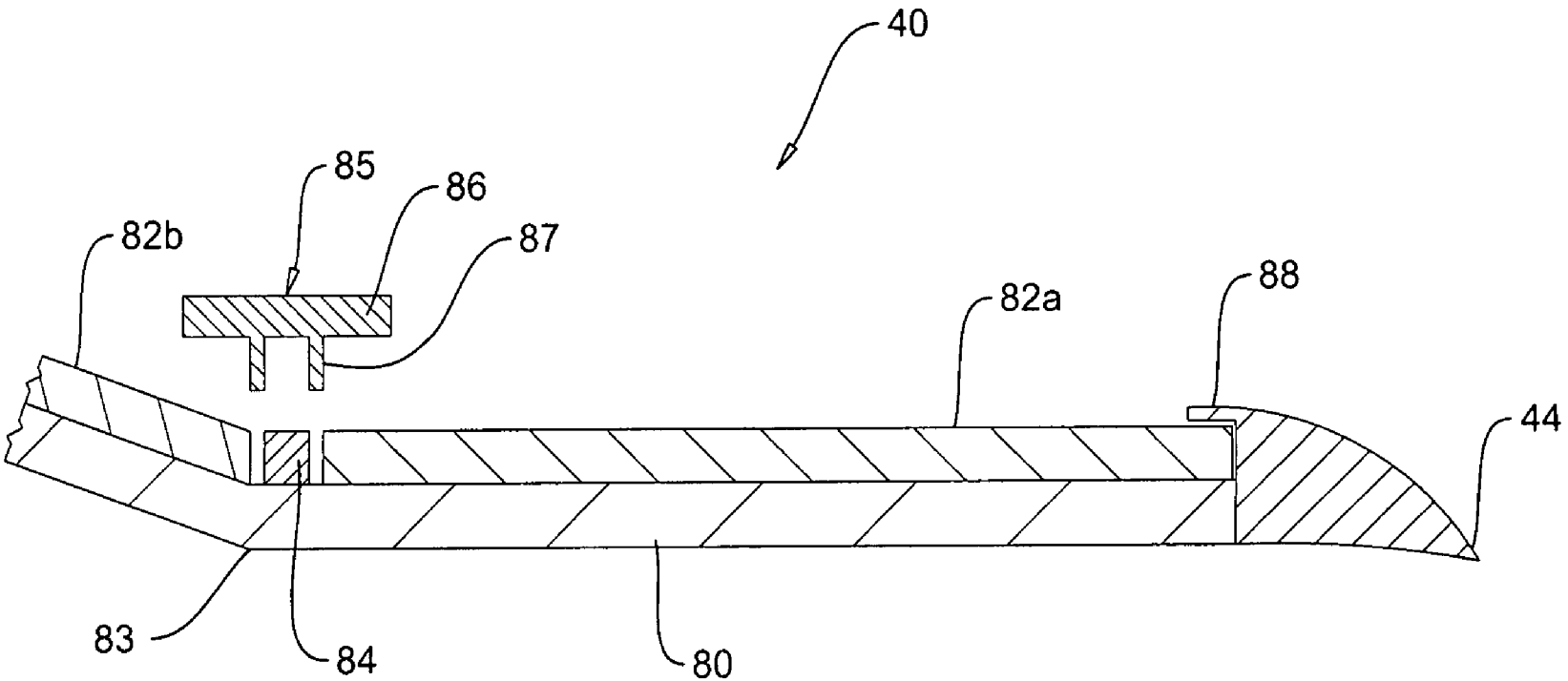
FIG. 7 is a cross-sectional view of the bottom screen of FIG. 6 taken along the line 7-7.

Turning to FIG. 7, a cross-sectional view of the construction of the bottom screen 40 is illustrated according to one embodiment of the present invention. The tines 80 of the bottom screen may extend between front and rear edges 44 and 46 of the bottom screen (only the front edge is illustrated in FIG. 7). As illustrated, the tines may have a bend 83 in the middle thereof. The bend 83 may include a perpendicularly extending middle bar member 84 extending thereacross. The screening material 82 may be comprised of first and second screening panels 82*a* and 82*b* located between the middle bar member 84 and their respective end of the bottom screen. The bucket 10 may also include a retaining bar 85 comprising an elongate flat bar 86 having wedges 87 extending from the bottom thereof. The wedges 87 are spaced apart by a distance sufficient for them to be frictionally fitted between the first or second screening member 82*a* or 82*b* and the middle bar member 84. The resulting frictional fit will retain the flat bar 86 above the edge of the screening member and therefore retain it against the tines 80. The other end of the screening member may be retained by a lip 88 or other suitable means on the front or rear edge 44 or 46. Utilizing the above method, it has been found that screening members formed of machined 1 inch thick UHMW material has been satisfactory although other material types and thicknesses may be useful as well.

The front screen 60 may be similarly formed as described above for the bottom screen. Alternatively, the front screen may be formed of a thicker material of up to 2 inches or more and retained in place with fasteners which extend through the screening member and the tines, such as by way of non-limiting example, clavicles, clamps or the like.

While specific embodiments of the invention have been described and illustrated, such embodiments should be considered illustrative of the invention only and not as limiting the invention as construed in accordance with the accompanying claims.

What is claimed is:

1. A multi-configurable bucket for screening material comprising:

a blade having a bottom edge, a top edge and a connector therebetween for securing to a distal end of an arm of an earth moving equipment;

a bottom screen having front and rear edges being rotatable about said top edge of said blade section, said bottom screen being positionable so as to extend angle away from said bottom edge of said blade;

a front screen rotatable relative to said bottom screen having a main screen portion and an angled end screen portion, said front screen being positionable to a closed position proximate said front edge of said bottom screen such that said front edge of said bottom screen extends past said end screen portion of said front screen.

2. The bucket of claim 1 wherein said bottom screen is pivotally connected to said blade proximate to said top edge thereof.

3. The bucket of claim 1 wherein said front screen is pivotally connected to said blade proximate to said top edge thereof.

4. The bucket of claim 1 wherein said front screen and said bottom screen are pivotally connected to said blade proximate to said top edge thereof at a common pivot.

5. The bucket of claim 1 wherein at said closed position said end screen portion of said front screen angles towards said blade.

6. The bucket of claim 5 wherein at said closed position, said front edge of said bottom screen extends past said end screen portion of said front screen by at least 6 inches.

7. The bucket of claim 6 wherein said main screen portion and said end screen portion of said front screen and said bottom screen form a segmented screening surface.

8. The bucket of claim 3 wherein said main screen portion and said end screen portion of said front screen and said bottom screen are angularly oriented relative to each other by angles of greater than 100 degrees.

9. The bucket of claim 1 wherein said front screen is openable so as to permit said blade and said bottom screen to excavate soil material.

10. The bucket of claim 1 wherein said bottom screen comprises a substantially planar screening surface supported by opposed side plates.

11. The bucket of claim 1 wherein said bottom screen and said front screen are formed of plastic.

12. The bucket of claim 11 wherein said bottom screen and said front screen are supported by a plurality of parallel spaced apart tines.

13. The bucket of claim 12 wherein said front edge of said bottom screen extends past said tines of said end screen portion of said front screen by at least 6 inches.

* * * * *